United States Patent [19]

Brown

[11] 4,070,863

[45] Jan. 31, 1978

[54] SLUICE GATE ASSEMBLY WITH EXTRUDABLE SEAL

[75] Inventor: David C. Brown, Petersham, Mass.

[73] Assignee: Rodney Hunt Company, Orange, Mass.

[21] Appl. No.: 740,767

[22] Filed: Nov. 5, 1976

[51] Int. Cl.[2] ..... E02B 7/28

[52] U.S. Cl. ..... 61/28; 61/22 A

[58] Field of Search ..... 61/28, 22; 277/190; 251/158, 147; 160/209, 194, 188; 114/202, 203

[56] References Cited

U.S. PATENT DOCUMENTS

| | | | |
|---|---|---|---|
| 1,948,770 | 2/1934 | Rowe | 160/209 |
| 2,139,779 | 12/1938 | Stratton | 160/209 X |
| 2,643,521 | 6/1953 | Hatch | 61/28 |
| 2,697,998 | 12/1954 | Jernstrom | 114/202 |
| 2,844,118 | 7/1958 | Kummerman | 114/202 |
| 3,237,915 | 3/1966 | Palmer et al. | 251/158 |

FOREIGN PATENT DOCUMENTS

| | | | |
|---|---|---|---|
| 1,116,098 | 10/1961 | Germany | 114/202 |
| 685,012 | 12/1952 | United Kingdom | 61/28 |
| 854,082 | 11/1960 | United Kingdom | 114/203 |

*Primary Examiner*—Dennis L. Taylor

*Attorney, Agent, or Firm*—Thompson, Birch, Gauthier & Samuels

[57] ABSTRACT

A sluice gate assembly has a resilient seal member mounted on the gate disc for movement therewith relative to a stationary frame. The frame has seat facings against which seat facings on the gate disc are urged when the gate disc is seated in the closed position. The resilient seal member is normally spaced from the frame and its seat facings when the gate disc is in other than the seated closed position. As the gate disc is seated in the closed position, a wedge-actuated seal retainer exerts a force on the resilient seal member to deform it against the frame seat facings.

9 Claims, 8 Drawing Figures

SLUICE GATE ASSEMBLY WITH EXTRUDABLE SEAL

BACKGROUND OF THE INVENTION

1. Field of the Invention

This invention relates generally to sluice gate assemblies of the type having a gate disc movable relative to a stationary frame. The frame borders an opening through which the flow of a liquid is either prevented or controlled by the position of the gate disc. The frame has seat facings against which seat facings on the gate disc are urged when the gate disc is seated in the closed position. The invention is directed primarily to the provision of a resilient seal member on the gate disc which is normally spaced from the frame and its seat facings when the gate disc is in other than the seated closed position, and which is deformed against the frame seat facings by a wedge-actuated seal retainer as the gate disc is seated in the closed position.

2. Description of the Prior Art

In conventional sluice gate assemblies, the stationary frame is normally provided with machined metal seat facings against which are urged cooperating machined metal seat facings on the gate disc to provide a seal between the frame and the gate disc when the latter is seated in the closed position. Usually, a wedge arrangement is employed to seat the gate disc in the closed position.

Experience has indicated that such arrangements are prone to leakage because in practice it is difficult if not impossible to insure that the opposed seat facings on the gate disc and frame always assume the desired face-to-face relationship which is essential to the maintenance of sealing integrity when the gate disc is seated in the closed position. This is due in part to normal manufacturing irregularities, as well as to the subsequent interposition of small amounts of foreign matter between the seat facings.

In an attempt at solving this problem, it has heretofore been proposed to provide resilient seals in slidable contact with either the gate disc or the outer frame. While such arrangements do aid in improving sealing integrity, other problems are created which offset any advantage gained. For example, as compared with conventional metal seat facings, resilient seals have high coefficients of friction which greatly increase frictional resistance to movement of the gate discs. This in turn places undesirably high loads on the operating stems. Resilient seal materials are also more susceptible to abrasive damage, a drawback which of course is aggravated by their high coefficients of friction.

Other prior art arrangements include toggle or eccentric means to retract resilient seals. Generally, these are undesirable because they require submerged moving parts and additional actuating mechanisms. Inflatable seals have also been tried without success due to leakage and the need for separate inflating means.

SUMMARY OF THE INVENTION

The present invention solves the above-mentioned problems by mounting a resilient seal member on the gate disc. The resilient seal member is normally spaced from the frame and its seat facings when the gate disc is in other than the seated closed position. The resilient seal member is deformed against the frame seat facings by a wedge actuated arrangement responsive to movement of the gate disc into the seated closed position.

In a preferred embodiment to be hereinafter described in more detail, a sluice gate assembly is shown comprising a stationary frame bordering an opening, guide members mounted on the frame on opposite sides of the opening, a gate disc carrying a resilient seal member extending around the periphery thereof, and a seal retainer surrounding the resilient seal member. The gate disc, resilient seal member and seal retainer are interconnected to move as a unit, and the seal retainer has flanges which are slidably received in grooves in the guide members to thereby guide the aforesaid unit as the gate disc is moved between a seated closed position and open positions allowing liquid to flow through the frame opening. The frame and the gate disc are each provided with seat facings, and the resilient seal member is normally spaced from the frame and its seat facings when the gate disc is in other than its seated closed position. A wedge system responsive to movement of the gate disc and its associated components operates to exert a force on the seal retainer as the gate disc is seated in the closed position. This force acts through the seal retainer to cause the resilient seal member to be deformed into sealing engagement with the frame seat facings.

Since the aforesaid deformation occurs only as the gate disc is seated in the closed position, the resilient seal member is not exposed to significant abrasive damage, nor does the resilient seal member complicate or hinder movement of the gate disc relative to the frame.

DESCRIPTION OF PREFERRED EMBODIMENT

Figure 1:
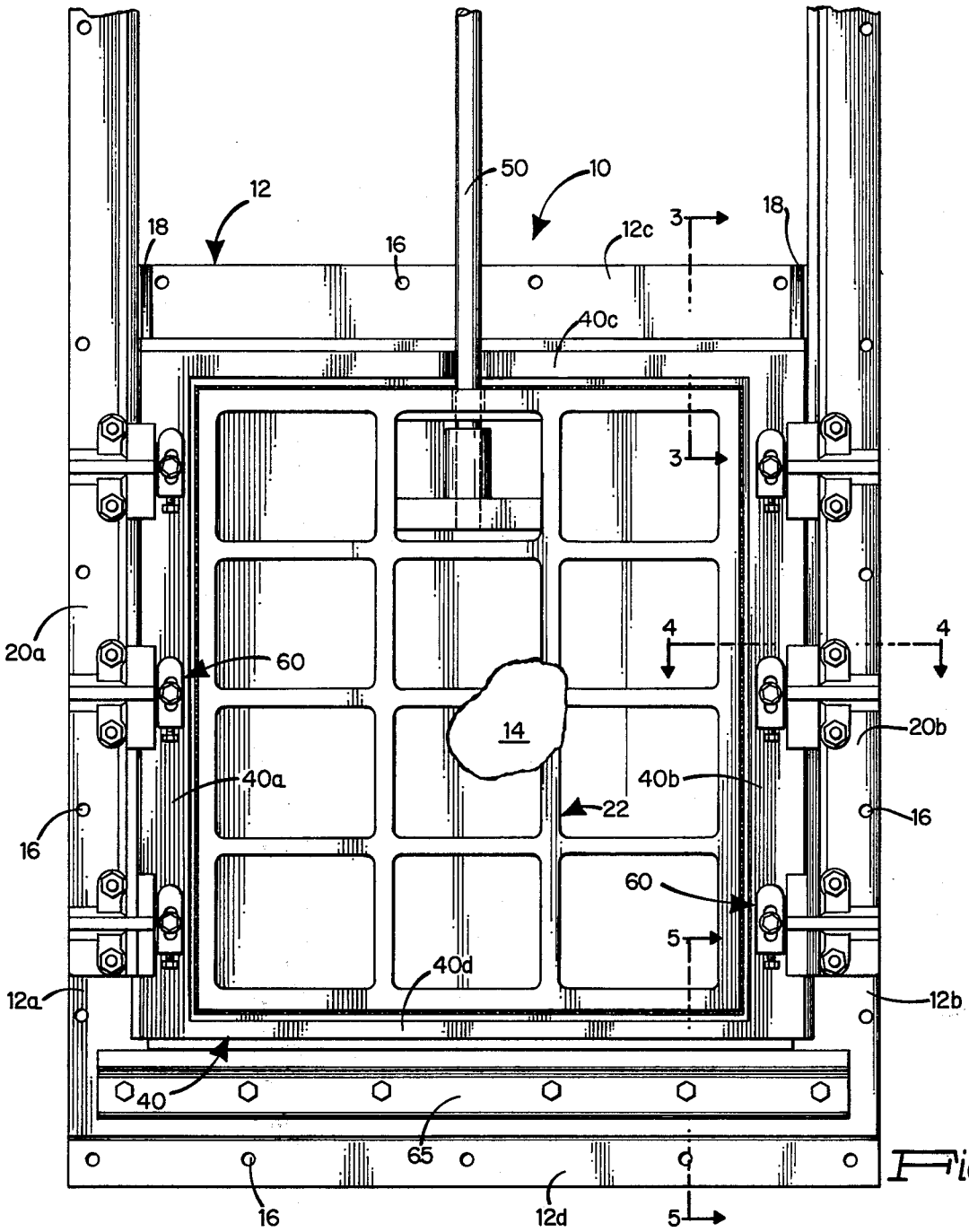
FIG. 1 is a view in front elevation of a sluice gate assembly embodying the concepts of the present invention.
Figure 2:
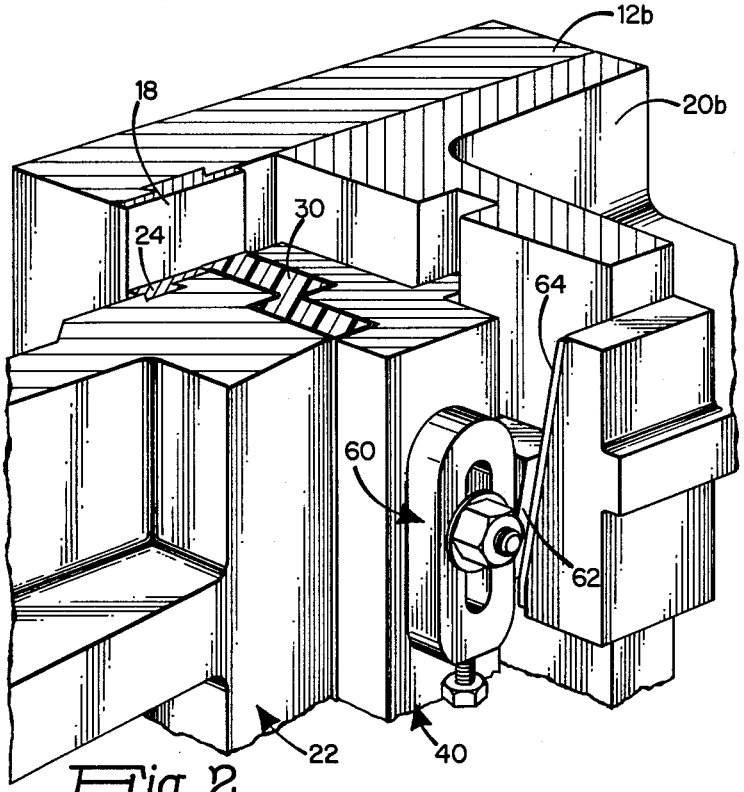
FIG. 2 is a partial sectional view taken through one side of the sluice gate assembly shown in FIG. 1 with the gate disc in the seated closed position.

Referring initially to FIGS. 1 and 2, there is shown at 10 a sluice gate assembly having a generally rectangular frame 12 adapted to border an opening 14. The frame preferably is comprised of a unitary casting with parallel side members **12*a*, 12*b* and vertically spaced top and bottom members 12*c*, 12*d*. The frame is provided with appropriately drilled holes indicated typically at 16 through which bolts or other fastening devices may extend to provide a means of fastening the frame in place. The frame has seat facings 18 secured thereto. Preferably, the frame will be fabricated as an iron casting, and the seal facings 18 will comprise bronze extrusions which are impacted into dove-tailed grooves in the frame, and then accurately machined. It will thus be understood that the frame 12, preferably although possibly not necessarily including seat facings 18**, constitutes an outer frame support adapted to be fixed in place adjacent to an opening through which fluid flow is to be controlled.

Figure 4A:
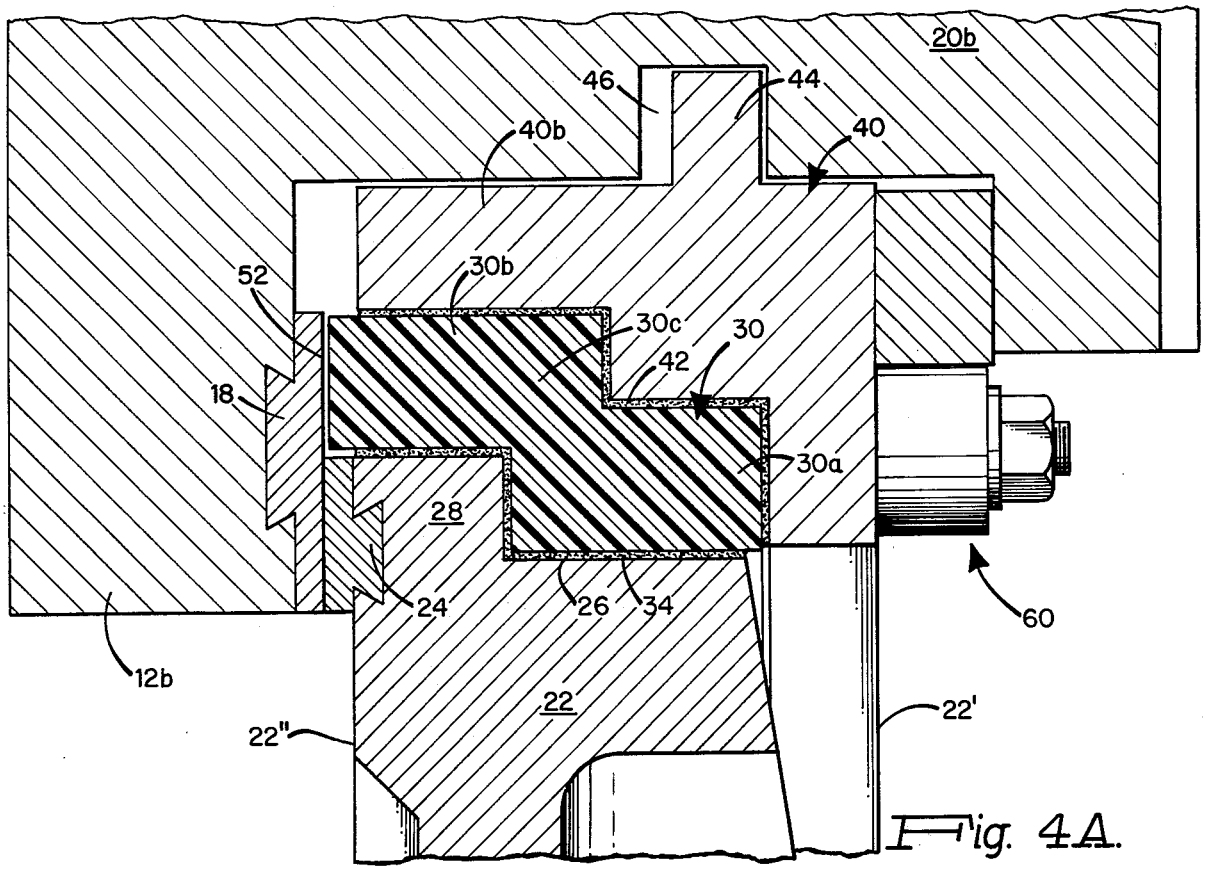
Figure 4B:
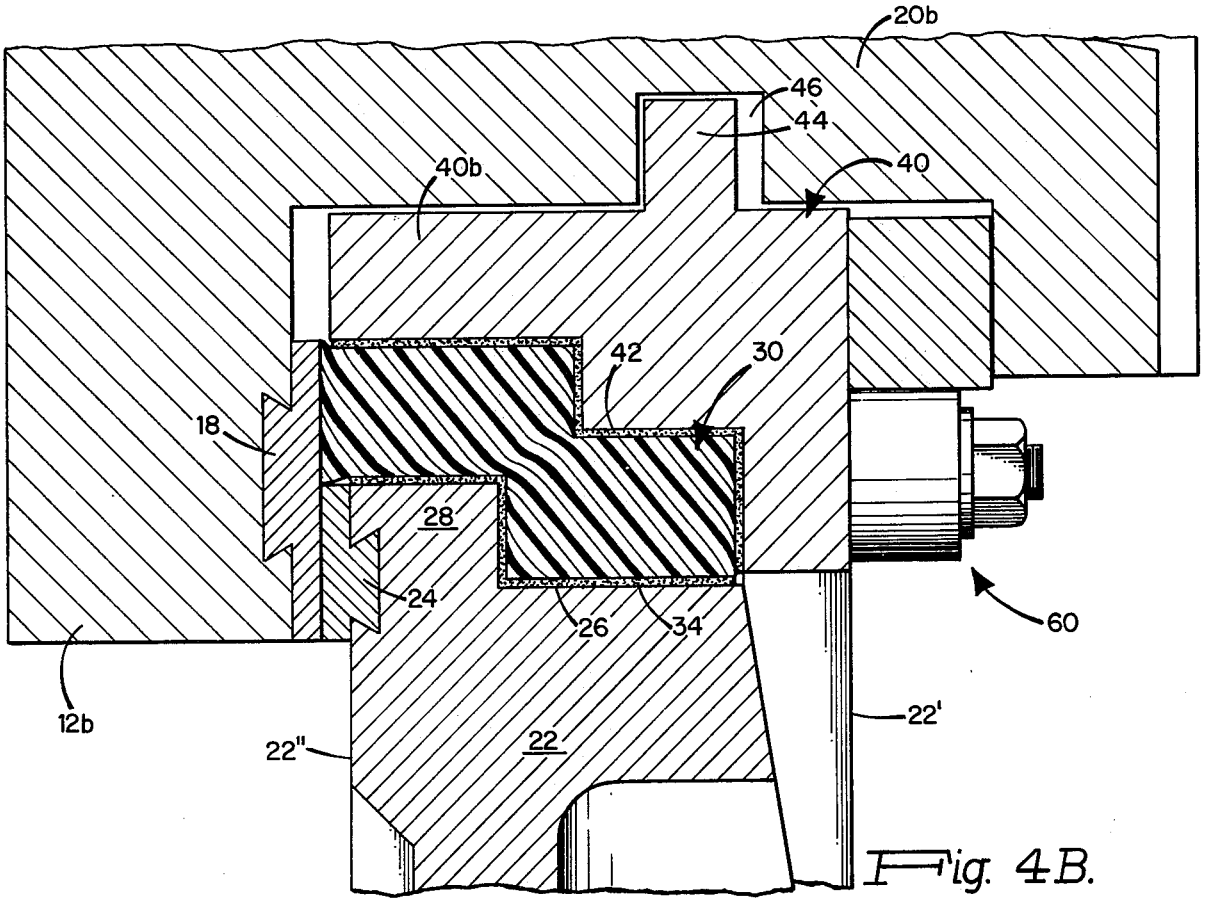

Gate disc guides 20*a*, 20*b* are mounted on the frame 12 on opposite sides of the opening 14. A gate disc 22 is located between the gate disc guides 20*a*, 20*b*. As is best shown in FIGS. 4A and 4B, the gate disc 22 has a front side 22′ and a back side 22″ facing the frame 12. The gate disc is provided with parallel seat facings 24 on its back side 22″ which are similar in composition and mounting to the seat facings 18 on the frame 12.

The periphery of gate disc 22 includes flat side, bottom and top surfaces 26 (see FIGS. 4A and 4B) which extend from the front side 22′ of the gate disc back towards a peripheral shoulder 28 adjacent to the back side 22″ of the gate disc.

A resilient seal member 30 extends around the periphery of the gate disc 22. As shown in FIG. 4A, when viewed in cross-section, the seal member 30 is provided with generally rectangular staggered front and rear sections 30*a*, 30*b* which overlap at an intermediate connecting portion 30*c*, with the inner surface of the seal member 30 thus being appropriately shaped to conform to the configuration of the periphery of the gate disc 22. The seal member 30 may be attached to the gate disc 22 by any convenient means, for example by being adhesively secured thereto as at 34.

A seal retainer 40 surrounds the seal member 30. The seal retainer preferably comprises a single rigid assembly having parallel sides 40*a*, 40*b* interconnected by top and bottom sections 40*c*, 40*d*. When viewed in cross-section, it will be seen that the inner periphery of the seal retainer is provided with a stepped configuration which conforms to the outer periphery of the seal member 30. In the embodiment herein being described, the seal retainer 40 is held in place by being adhesively bonded to the seal member 30 as at 42.

It will thus be seen that the gate disc 22, resilient seal member 30 and seal retainer 40 are interconnected as a single unit. The seal retainer 40 has side flanges 44 which extend laterally into guide grooves 46 in the gate disc guides 20*a*, 20*b*.

A stem 50 connects the gate disc 22 to an operating mechanism (not shown) which can be of any known conventional design. The operating mechanism works through the stem 50 to adjust the position of gate disc 22 and its associated components in relation to the outer frame 12 and the gate disc guides 20*a*, 20*b*. Movement of the gate disc 22 takes place between a closed seated position as shown for example in FIG. 1 and open positions which allow liquid to flow through the frame opening 14 beneath the lower edge of the gate disc. Movement of the gate disc 22 is guided by the cooperative action of the side flanges 44 in the guide grooves 46, and also to some extent by the opposed seat facings 18, 24 on the frame 12 and gate disc 22.

Figure 3A:
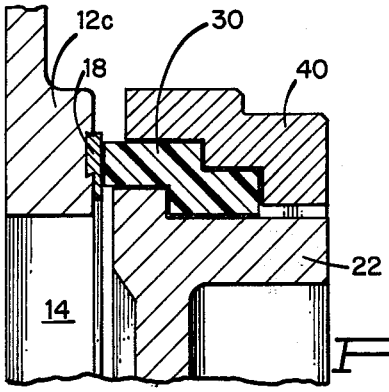
FIGS. 3A, 4A and 5A are sectional views taken on lines 3–3, 4–4 and 5–5 of FIG. 1 showing the relationship of the various components making up the sluice gate assembly when the gate disc is in other than its seated closed position; and, FIGS. 3B, 4B and 5B are sectional views similar to FIGS. 3A, 4A and 5A showing the relationship of the same components when the gate disc is in the seated closed position.
Figure 5A:
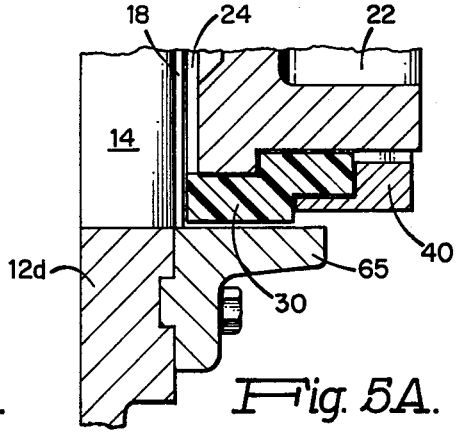

When the gate disc 22 is in other than the seated closed position, as shown by FIGS. 3A, 4A and 5A, the sealing face 52 (see FIG. 4A) of resilient seal member 30 is spaced from the frame 12 and its seat facings 18. Thus, during most adjustments of the gate disc, the sealing face 52 is not in frictional contact with other stationary metallic surfaces. This safeguards the resilient seal member 30 against abrasive wear, and also minimizes frictional resistance to movement of the gate disc.

The seal retainer 40 carries adjustable wedge assemblies indicated typically at 60. As is best shown in FIG. 2, the wedge assemblies have inclined wedge surfaces 62 arranged to cooperate in frictional engagement with oppositely inclined wedge seats 64 secured to the gate disc guides 20*a*, 20*b*. This cooperative wedging action, which takes place as the gate disc 22 arrives at the closed position, results in a rearward force being exerted on the seal retainer 40. This rearward force, which is in effect a "seating" force, accomplishes two objectives: first, the gate disc is pushed rearwardly to bring its seat facings 24 into contact with the seat facings 18 on the frame 12. Secondly, and as is best shown in FIG. 4B, the seal retainer 40 deforms or extrudes the resilient seal member 30 to cause its sealing face 52 to bear against the frame seat facings 18. This deformation of the resilient seal member, which completes the seating of the gate disc in the closed position, is occasioned by moving the seal retainer 40 relative to the gate disc 22 in a direction transverse to the direction of travel of the gate disc between its open and closed positions. The resulting sealing interface between the resilient seal member 30 and the frame seat facings 18 fully compensates for manufacturing irregularities and/or the interposition of small foreign particles which may prevent the opposed seat facings 18, 24 from coming into tight face-to-face sealing engagement.

Figure 3B:
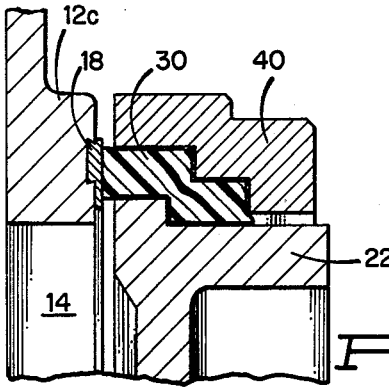
Figure 5B:
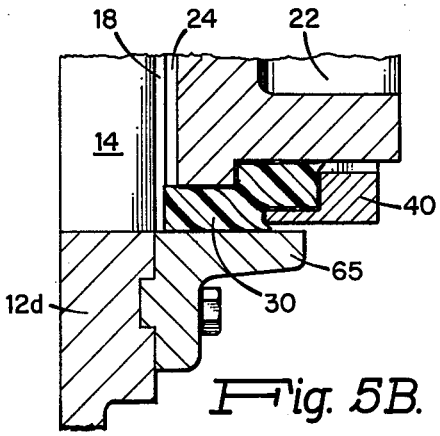

A comparison of FIGS. 3A, 4A, 5A with FIGS. 3B, 4B, 5B, shows that the aforesaid deformation of seal member 30 occurs around the entire periphery of the gate disc. The deformation seal member 30 along the bottom edge is by and large ineffective, because at this location sealing is achieved at the interface between the bottom surface of the seal member and a bottom seal plate 65 secured to the frame bottom 12*d*.

When an opening force is exerted on the gate disc through stem 50, the wedges 60 are immediately disengaged, thereby unloading the rearward force on seal retainer 40. This allows the resilient seal member 30 to return to its normal position wherein the sealing face 52 is spaced from the frame seat facings 18, and thus safeguarded from abrasive wear. This retraction of the sealing face 52 facilitates subsequent adjustment of the gate disc by minimizing frictional resistance to movement.

It is to be understood by those skilled in the art that various modifications can be made to the above-described embodiment without departing from the spirit and scope of the invention. For example, under certain circumstances, it may be possible to employ a resilient seal member and associated seal retainer which partially rather than completely surround the gate disc. Means other than or in addition to an adhesive may be employed to interconnect the gate disc, resilient seal member and seal retainer. Also, the cross-sectional configuration of the resilient seal member can be varied, depending on the design of the gate disc and seal retainer.

It is my intention to cover these and any other changes or modifications to the embodiment herein chosen for purposes of disclosure which are encompassed by the breadth of the claims hereinafter set forth.

I claim:

1. A sluice gate assembly comprising: a frame bordering an opening, said frame having first seat facings; a gate disc having second seat facings, said gate disc being movable between a seated closed position at which said second seat facings are urged against said first seat facings, and an open position allowing liquid to pass through said openings; a resilient deformable seal member mounted on said gate disc, said seal member being normally spaced from said first seat facings when said gate disc is in other than the seated closed position; deforming means carried by and responsive to movement of said gate disc into the seated closed position for deforming said seal member against said first seat facings, said deforming means including a seal retainer interconnected into an integral unit with said seal member and said gate disc; and wedge means for moving said seal retainer relative to said gate disc to produce the aforesaid deformation of said seal member.

2. The apparatus as claimed in claim 1 wherein said resilient deformable seal member and said seal retainer extend around the entire periphery of said gate disc.

3. The apparatus as claimed in claim 2 further comprising guide members mounted on said frame on opposite sides of said opening, said seal retainer having laterally extending flanges slidably received in grooves in said guide members.

4. The apparatus as claimed in claim 3 wherein said wedge means is comprised of wedge members on said seal retainer adapted to cooperate with wedge seats on said guide members during movement of said gate disc relative to said frame.

5. The apparatus as claimed in claim 2 wherein said resilient deformable seal member is interposed between said gate disc and said seal retainer.

6. The apparatus as claimed in claim 5 wherein said resilient deformable seal member is adhesively secured to both said gate disc and said seal retainer.

7. The apparatus as claimed in claim 1 wherein said wedge means is operative to move said retainer relative to the gate disc in a direction transverse to the direction of travel of said gate disc between said open and closed positions.

8. A sluice gate assembly comprising: a stationary outer frame support bordering an opening; guide members mounted on said frame support on opposite sides of said opening, said guide members having opposed parallel guide grooves; a gate disc; a resilient seal member extending around the periphery of said gate disc; a seal retainer surrounding said resilient seal member, said seal retainer having opposed flanges slidably received in the parallel guide grooves of said guide members; means for interconnecting said gate disc, said resilient seal member and said seal retainer for movement as a unit between open and closed positions relative to said outer frame support and said guide members, said resilient seal member being normally spaced from said frame support when said gate disc is in other than the closed position; and, wedge means operatively associated with said seal retainer and said guide members for exerting a force on said resilient seal member as the gate disc arrives at the closed position to deform said resilient seal member against said frame support.

9. A sluice gate assembly comprising: a frame surrounding an opening; guides mounted on said frame on opposite sides of said opening; a gate disc guided by said guides for movement between a seated closed position and open positions permitting liquid to flow through said opening; opposed seat facings on said gate disc and said frame which cooperate with said guides in guiding the gate disc and which are urged together when the gate disc is in the seated closed position; a resilient deformable seal member mounted on said gate disc, said seal member having a sealing face which is normally spaced from said frame and its seat facings; and, means carried by and responsive to movement of said gate disc into the seated closed position for deforming said seal member against the seat facings on said frame, said means including a seal retainer engageable with said seal member; and wedge means for moving said seal retainer relative to said gate disc to produce the aforesaid deformation of said seal member.

* * * * *